US009313831B2

(12) United States Patent
Hayashinaka et al.

(10) Patent No.: US 9,313,831 B2
(45) Date of Patent: Apr. 12, 2016

(54) INDUCTION HEATING APPARATUS CAPABLE OF AVOIDING UNSTABLE HEATING DUE TO LIMITATION OF HEATING OUTPUT

(75) Inventors: Teruo Hayashinaka, Hyogo (JP); Yoshihiro Yamashita, Hyogo (JP); Yuji Fujii, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 426 days.

(21) Appl. No.: 14/002,229

(22) PCT Filed: Jul. 5, 2012

(86) PCT No.: PCT/JP2012/004370
§ 371 (c)(1),
(2), (4) Date: Aug. 29, 2013

(87) PCT Pub. No.: WO2013/080401
PCT Pub. Date: Jun. 6, 2013

(65) Prior Publication Data

US 2013/0334211 A1 Dec. 19, 2013

(30) Foreign Application Priority Data

Dec. 2, 2011 (JP) ..... 2011-264244

(51) Int. Cl.
*H05B 6/08* (2006.01)
*H05B 6/12* (2006.01)
*H05B 6/06* (2006.01)

(52) U.S. Cl.
CPC . *H05B 6/08* (2013.01); *H05B 6/065* (2013.01)

(58) Field of Classification Search
CPC ..... H05B 6/08; H05B 6/065
USPC ..... 219/662, 619, 620, 601, 622, 625, 627, 219/665, 626, 663, 664; 363/37, 49, 89, 98
See application file for complete search history.

(56) References Cited

U.S. PATENT DOCUMENTS 6,936,800 B2 * 8/2005 Kinouchi ..... G03G 15/2042 219/619
2012/0248095 A1 * 10/2012 Lee ..... H05B 6/1263 219/620
2013/0334212 A1 * 12/2013 Sawada ..... H05B 6/065 219/662

FOREIGN PATENT DOCUMENTS

CN 1937863 A 3/2007
EP 1 951 003 A1 7/2008

(Continued)

OTHER PUBLICATIONS

Office Action and Search Report with partial English translation for Chinese Patent Application Serial No. 201280010652.2, dated Oct. 30, 2014, 7 pages.

(Continued)

*Primary Examiner* — Quang Van
(74) *Attorney, Agent, or Firm* — Brinks Gilson & Lione

(57) ABSTRACT

When the control unit makes both the first and second inverter circuits operational, the control unit controls the first and second inverter circuits by duty control such that an average heating output from the first inverter circuit reaches a predetermined first target heating output, and an average heating output from the second inverter circuit reaches a predetermined second target heating output. When the control unit makes one of the first and second inverter circuits operational in an automatic heating mode for automatic heating control according to a predetermined heating output sequence, the control unit inhibits the first and second inverter circuits from being controlled by the duty control.

7 Claims, 3 Drawing Sheets

(56) References Cited

FOREIGN PATENT DOCUMENTS

| | | | |
|---|---|---|---|
| JP | 05-166579 | A | 7/1993 |
| JP | 2004-235032 | A | 8/2004 |
| JP | 2005-142044 | A | 6/2005 |
| JP | 2007-080751 | A | 3/2007 |
| JP | 2010-055873 | A | 3/2010 |
| JP | 2010-212052 | A | 9/2010 |
| JP | 2011-243405 | A | 12/2011 |

OTHER PUBLICATIONS

International Preliminary Report on Patentability, and English translation thereof, in corresponding International Application No. PCT/JP2012/004370, dated Jun. 12, 2014, 10 pages.
Extended European Search Report in corresponding European Application No. 12854290.9, dated Mar. 17, 2015, 5 pages.
International Search Report for International Application No. PCT/JP2012/004370, dated Jul. 31, 2012, 2 pages.

* cited by examiner

*Fig.3* *Prior Art*
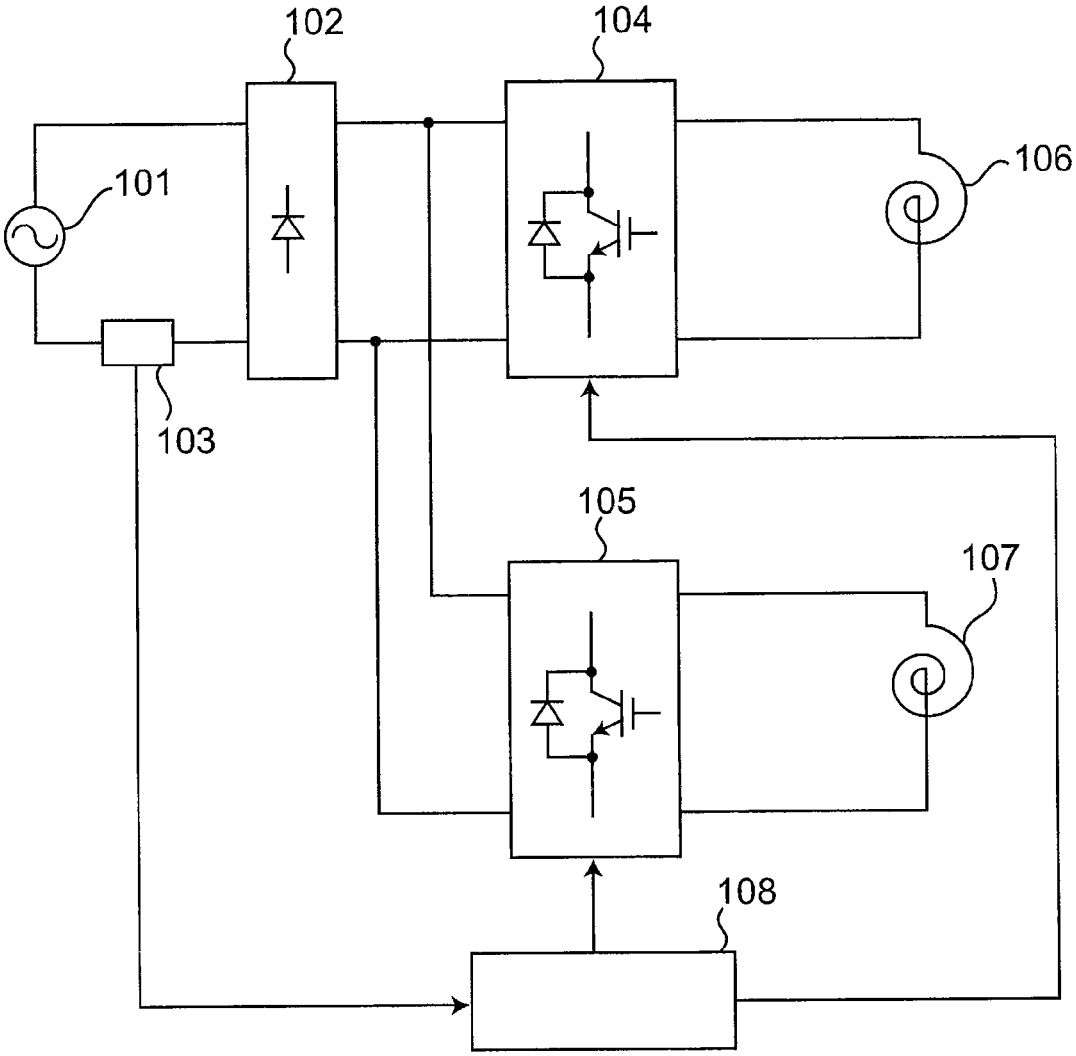

INDUCTION HEATING APPARATUS CAPABLE OF AVOIDING UNSTABLE HEATING DUE TO LIMITATION OF HEATING OUTPUT

This application is a 371 application of PCT/JP2012/004370 having an international filing date of Jul. 5, 2012, which claims priority to JP2011-264244 filed Dec. 2, 2011, the entire contents of which are incorporated herein by reference.

TECHNICAL FIELD

The present invention relates to an induction heating apparatus provided with two inverter circuits, and more particularly, an induction heating apparatus performing duty control in which, when two inverter circuits simultaneously operate for heating, the inverter circuits are controlled to alternate between a high heating power mode and a low heating power mode in predetermined cycles.

BACKGROUND ART

FIG. 3 is a block diagram showing a configuration of a conventional induction heating apparatus, for example, disclosed in Patent Literature 1. The induction heating apparatus of FIG. 3 performs duty control in which, when two inverter circuits simultaneously operate for heating, the inverter circuits are controlled to alternate between a high heating power mode and a low heating power mode in predetermined cycles. Referring to FIG. 3, the conventional induction heating apparatus is provided with: a rectifier circuit 102 rectifying alternating-current power from an alternating-current power supply 101; a first inverter circuit 104 converting output power from the rectifier circuit 102, to high-frequency power, and supplying a current to a first heating coil 106; a second inverter circuit 105 converting output power from the rectifier circuit 102, to high-frequency power, and supplying a current to a second heating coil 107; current detection means 103 for detecting an input current from the alternating-current power supply 101; and control means 108 for controlling the durations of ON periods of a plurality of semiconductor switches in the first inverter circuit 104 and the second inverter circuit 105 according to the detection result obtained by the current detection means 103.

In this case, after an input current to one of the first inverter circuit 104 and the second inverter circuit 105 reaches a target value, the control means 108 makes the one inverter circuit and the other inverter circuit operational simultaneously. In addition, when the first and second inverter circuits 104 and 105 operates simultaneously, at least one of the inverter circuits performs duty control including ON periods and OFF periods. Therefore, even when the two inverter circuits 104 and 105 share the rectifier circuit 102 and the current detection means 103, it is possible to supply an amount of power to each of the first inverter circuit 104 and the second inverter circuit 105. In addition, since an input current can be detected accurately, it is possible to accurately supply an amount of power to each of the inverter circuits 104 and 105.

Patent Literature 1: Japanese Patent laid-open Publication No. 2010-212052 A

SUMMARY OF THE INVENTION

Technical Problem

In the case of the duty control, the conventional induction heating apparatus repeats an ON period in which semiconductor switches in the inverter circuit are driven in a predetermined switching cycle, and an OFF period in which the semiconductor switches are turned off, a cycle of the ON period and the OFF period being sufficiently longer than the switching cycle. Therefore, a heating output from the inverter circuit is an average heating output of a heating output in the ON period and a heating output in the OFF period. Hence, in order to achieve a desired heating output by the duty control, it is necessary to obtain a larger heating output than the desired heating output, during the ON period. Accordingly, the maximum heating output under the duty control is larger than that of continuous heating control in which the semiconductor switches in the inverter circuit are continuously turned on for obtaining the desired heating output.

In general, an induction heating apparatus performs limit control for limiting a heating output from an inverter circuit to less than a predetermined value, in order to prevent a failure of the inverter circuit. The maximum heating output under duty control is larger than that of continuous heating control, which increases the possibility that a heating output under the duty control is limited by the limit control. Therefore, if a heating output is limited by limit control under duty control in an automatic heating mode for automatic heating control according to a predetermined heating output sequence, then it is not possible to achieve heating control with a predetermined heating output, making it difficult to achieve sufficient cooking performance.

An object of the present invention is to solve the above-described problems, and to provide an induction heating apparatus capable of avoiding a situation in which automatic heating control according to a predetermined heating output sequence cannot be performed due to limit control for limiting a heating output from an inverter circuit.

Solution to Problem

An induction heating apparatus according to the present invention is provided with: a first inverter circuit configured to supply a high-frequency current to a first heating coil; a second inverter circuit configured to supply a high-frequency current to a second heating coil; and a control unit configured to control the first and second inverter circuits. When the control unit makes both the first and second inverter circuits operational, the control unit controls the first and second inverter circuits by duty control such that an average heating output from the first inverter circuit reaches a predetermined first target heating output, and an average heating output from the second inverter circuit reaches a predetermined second target heating output. When the control unit makes only the first inverter circuit operational, the control unit controls the first inverter circuit by continuous heating control such that a heating output from the first inverter circuit reaches the first target heating output. When the control unit makes only the second inverter circuit operational, the control unit controls the second inverter circuit by the continuous heating control such that a heating output from the second inverter circuit reaches the second target heating output. When the control unit makes one of the first and second inverter circuits operational in an automatic heating mode for automatic heating control according to a predetermined heating output sequence, the control unit inhibits the first and second inverter circuits from being controlled by the duty control.

Thus, when one of the first and second inverter circuits is made operational in the automatic heating mode, only the one operating inverter circuit is controlled by the continuous heating control. Therefore, it is possible to achieve the predetermined target heating output at a lower maximum heating output than as compared to the case of controlling by the duty control. Hence, it is possible to avoid unstable heating control without sufficient cooking performance, arose from lack of heating control in the automatic heating mode, due to limitation of a heating output imposed by a limiter unit. Accordingly, it is possible to improve safety as compared to the prior art.

Advantageous Effects of the Invention

According to the induction heating apparatus of the present invention, when one of the first and second inverter circuits is made operational in the automatic heating mode for the automatic heating control according to the predetermined heating output sequence, the first and second inverter circuits are inhibited from being controlled by the duty control.

Thus, when one of the first and second inverter circuits is made operational in the automatic heating mode, only the one inverter circuit made operational is controlled by the continuous heating control. Therefore, it is possible to achieve the predetermined target heating output at a lower maximum heating output than as compared to the case of controlling by the duty control. Hence, it is possible to avoid unstable heating control without sufficient cooking performance, arose from lack of heating control in the automatic heating mode, due to limitation of a heating output imposed by a limiter unit. Accordingly, it is possible to improve safety as compared to the prior art.

BRIEF DESCRIPTION OF THE DRAWINGS

FIG. 3 is a block diagram showing a configuration of a conventional induction heating apparatus.

DETAILED DESCRIPTION OF THE PREFERRED EMBODIMENTS

Figure 1:
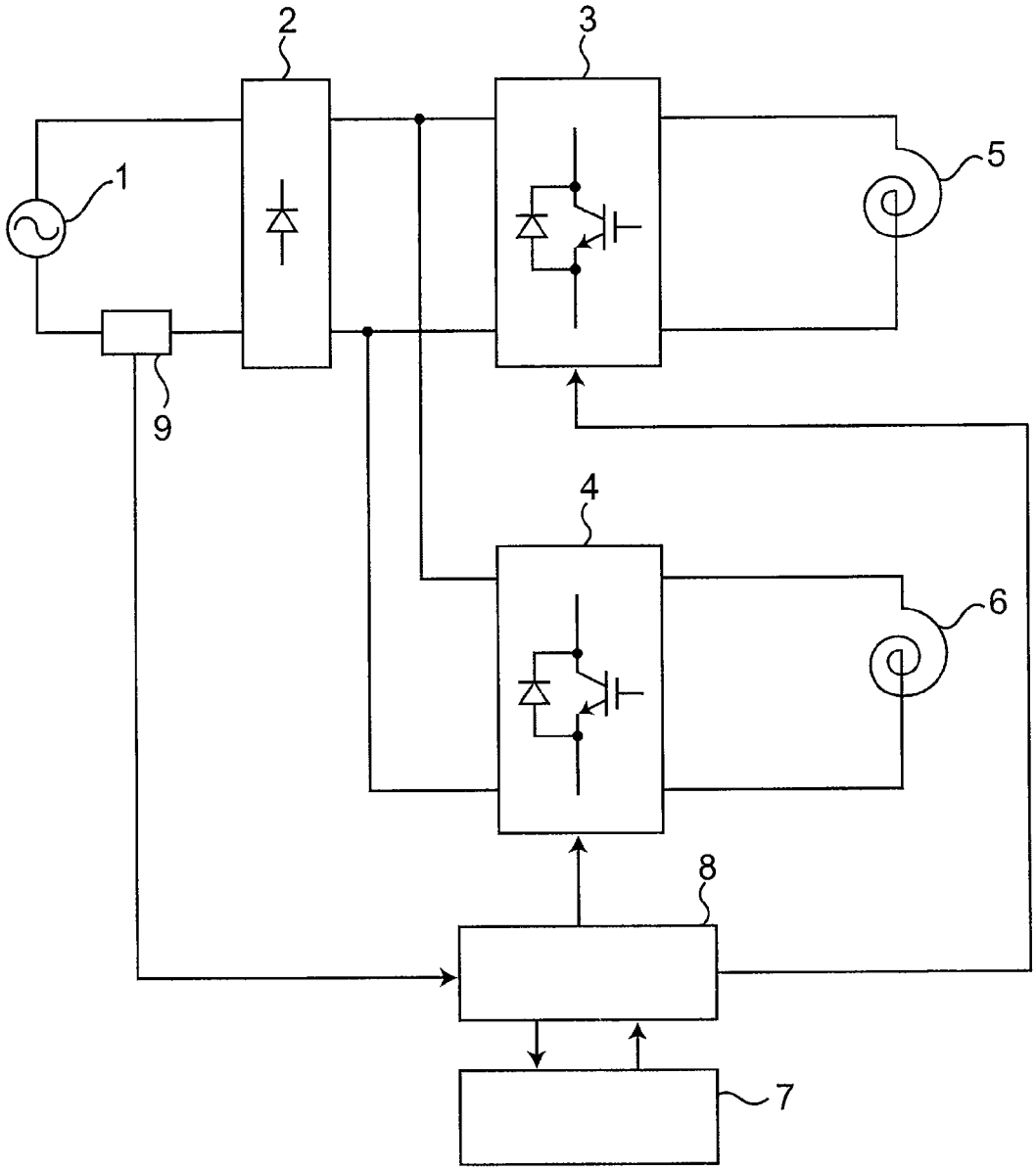
FIG. 1 is a block diagram showing a configuration of an induction heating cooker according to an embodiment of the present invention.

According to an induction heating apparatus of the first aspect, the induction heating apparatus is provided with:

a first inverter circuit configured to supply a high-frequency current to a first heating coil;

a second inverter circuit configured to supply a high-frequency current to a second heating coil; and a control unit configured to control the first and second inverter circuits, when the control unit makes both the first and second inverter circuits operational, the control unit controls the first and second inverter circuits by duty control such that an average heating output from the first inverter circuit reaches a predetermined first target heating output, and an average heating output from the second inverter circuit reaches a predetermined second target heating output, when the control unit makes only the first inverter circuit operational, the control unit controls the first inverter circuit by continuous heating control such that a heating output from the first inverter circuit reaches the first target heating output, when the control unit makes only the second inverter circuit operational, the control unit controls the second inverter circuit by the continuous heating control such that a heating output from the second inverter circuit reaches the second target heating output, and when the control unit makes one of the first and second inverter circuits operational in an automatic heating mode for automatic heating control according to a predetermined heating output sequence, the control unit inhibits the first and second inverter circuits from being controlled by the duty control.

Thus, when one of the first and second inverter circuits is made operational in the automatic heating mode, only the one inverter circuit made operational is controlled by the continuous heating control. Therefore, it is possible to achieve the predetermined target heating output at a lower maximum heating output than as compared to the case of controlling by the duty control. Hence, it is possible to avoid unstable heating control without sufficient cooking performance arose from lack of heating control in the automatic heating mode due to limitation of a heating output imposed by a limiter unit. Accordingly, it is possible to improve safety as compared to the prior art.

According to the induction heating apparatus of the second aspect, in the induction heating apparatus of the first aspect, when the control unit makes only one of the first and second inverter circuits operational, the control unit inhibits the other inverter circuit from being operational in the automatic heating mode.

There is a known control method for avoiding limitation of a heating output from an inverter circuit operating in an automatic heating mode imposed by a limiter unit, by suppressing the heating output from first or second inverter circuit when the heating output from the inverter circuit operating in the automatic heating mode exceeds a predetermined maximum heating output, in the case in which each of the first and second inverter circuits is controlled by duty control. On the other hand, according to the present aspect, heating is not suppressed based on a maximum heating output determined by the operation of the limiter unit depending on the material, size, etc., of a load to be heated. Thus, a user can easily understand how to use, as compared to the case of using the above-described control method. Therefore, it is possible to improve usability.

According to the induction heating apparatus of the third aspect, in the induction heating apparatus of the first or second aspect, when the control unit makes only one of the first and second inverter circuits operational in the automatic heating mode, the control unit inhibits the other inverter circuit from being operational.

The induction heating apparatus of the present aspect achieves the same advantageous effects as those of the induction heating apparatus of the second aspect.

According to the induction heating apparatus of the fourth aspect, the induction heating apparatus of any one of the first to third aspects is further provided with a limiter unit configured to determine whether or not each of the heating outputs from the first and second inverter circuits is equal to or larger than a predetermined heating output threshold, when the heating output from the first inverter circuit is determined to be equal to or larger than the heating output threshold, the control unit controls the first inverter circuit such that the heating output from the first inverter circuit reaches a predetermined value less than the heating output threshold, and when the heating output from the second inverter circuit is determined to be equal to or larger than the heating output threshold, the control unit controls the second inverter circuit such that the heating output from the second inverter circuit reaches a predetermined value less than the heating output threshold.

According to the induction heating apparatus of the fifth aspect, in the induction heating apparatus of any one of the first to fourth aspects, the control unit controls the first inverter circuit during a first period such that the heating output from the first inverter circuit reaches a predetermined first heating output larger than the first target heating output, the control unit controls the first inverter circuit during a second period subsequent to the first period such that the heating output from the first inverter circuit reaches a predetermined second heating output smaller than the first target heating output, and the control unit repeats the first period and the second period, and the control unit controls the second inverter circuit during the first period such that the heating output from the second inverter circuit reaches one of a predetermined third heating output larger than the second target heating output and a predetermined fourth heating output smaller than the second target heating output, the control unit controls the second inverter circuit during the second period such that the heating output from the second inverter circuit reaches the other one of the third and fourth heating outputs, and the control unit repeats the first period and the second period.

According to the induction heating apparatus of the sixth aspect, in the induction heating apparatus of the fifth aspect, the control unit controls the second inverter circuit during the first period such that the heating output from the second inverter circuit reaches the fourth heating output, and the control unit controls the second inverter circuit during the second period such that the heating output from the second inverter circuit reaches the third heating output, and the control unit sets each of the second and fourth heating outputs to substantially zero.

Therefore, since the first and second inverter circuits do not operate simultaneously, it is possible to eliminate interference sound (roaring sound).

According to the induction heating apparatus of the seventh aspect, the induction heating apparatus of any one of the first to sixth aspects is further provided with a rectifier circuit configured to rectify and smooth an alternating-current power from an alternating-current power supply and outputting a direct current, the first and second inverter circuits are connected to the rectifier circuit in parallel, and each of the first and second inverter circuits converts the direct current from the rectifier circuit, to the high-frequency current.

Hereinafter, an embodiment according to the present invention will be described below with reference to the drawings. It is noted that similar components are denoted by the same reference signs.

FIG. 1 is a block diagram showing a configuration of an induction heating cooker according to an embodiment of the present invention. Referring to FIG. 1, the induction heating cooker according to the present embodiment is provided with: a rectifier circuit 2 rectifying and smoothing alternating-current power from an alternating-current power supply 1 and outputting the rectified and smoothed power; a first inverter circuit 3 and a second inverter circuit 4 connected to the rectifier circuit 2 in parallel; a first heating coil 5; a second heating coil 6; a limiter unit 7; a control unit 8; and a current detecting unit 9.

In this case, the current detecting unit 9 detects a total input current inputted to the first inverter circuit 3 and the second inverter circuit 4 from the alternating-current power supply 1 through the rectifier circuit 2, and outputs a detection signal indicating the detection result, to the control unit 8. In addition, the first inverter circuit 3 is provided with a switching element. By driving the switching element under the control of the control unit 8, the first inverter circuit 3 converts a direct current outputted from the rectifier circuit 2, to a high-frequency alternating current, and supplies the high-frequency alternating current to the first heating coil 5. Further, the second inverter circuit 4 is provided with a switching element. By driving the switching element under the control of the control unit 8, the second inverter circuit 4 converts a direct current outputted from the rectifier circuit 2, to a high-frequency alternating current, and outputs the high-frequency current to the second heating coil 6.

The control unit 8 increases or decreases drive frequencies or ON durations of the switching elements of the first inverter circuit 3 and the second inverter circuit 4, based on the detection signal from the current detecting unit 9, such that an input current value supplied to the rectifier circuit 2 from the alternating-current power supply 1 reaches a target value. Specifically, when the control unit 8 makes both the first inverter circuit 3 and the second inverter circuit 4 operational, the control unit 8 first makes only one of the inverter circuits operational, and controls the one operating inverter circuit such that a heating output from the inverter circuit reaches a predetermined target heating output. Then, the control unit 8 further makes the other inverter circuit operational, and calculates an input current for the other inverter circuit by subtracting an input current flowing when only the one inverter circuit is made operational, from an input current detected by the current detecting unit 9. Based on the calculated input current, the control unit 8 controls the other inverter circuit such that a heating output from the other inverter circuit reaches a predetermined target heating output. The target heating output of the first inverter circuit 3 is a first target heating output, and the target heating output of the second inverter circuit 4 is a second target heating output. Further, the control unit 8 outputs to the limiter unit 7, control information of the first and second inverter circuits 3 and 4, such as the input currents inputted to the first and second inverter circuits 3 and 4, the ON durations of the switching elements in the first and second inverter circuits 3 and 4, and the voltages of the first and second heating coils 5 and 6.

The limiter unit 7 determines whether or not each of the heating outputs from the first and second inverter circuits 3 and 4 is equal to or larger than a predetermined heating output threshold, based on the control information of the first and second inverter circuits 3 and 4 inputted from the control unit 8. Then, the limiter unit 7 outputs a signal indicating the determination result, to the control unit 8. In response to this, when it is determined that the heating output from the first inverter circuit 3 is equal to or larger than the heating output threshold, the control unit 8 controls the first inverter circuit 3 such that the heating output from the first inverter circuit 3 reaches a predetermined value less than the heating output threshold, and when it is determined that the heating output from the second inverter circuit 4 is equal to or larger than the heating output threshold, the control unit 8 controls the second inverter circuit 4 such that the heating output from the second inverter circuit 4 reaches a predetermined value less than the heating output threshold. The heating output threshold is set to be smaller than a heating output at which a failure of the first and second inverter circuits 3 and 4 occurs.

Next, the operation of the control unit 8 will be described in detail. When the control unit 8 makes only the first inverter circuit 3 operational, the control unit 8 controls the first inverter circuit 3 by continuous heating control such that a heating output from the first inverter circuit 3 continuously reaches the first target heating output. When the control unit 8 makes only the second inverter circuit 4 operational, the control unit 8 controls the second inverter circuit 4 by the continuous heating control such that a heating output from the second inverter circuit 4 continuously reaches the second target heating output. Specifically, during the continuous heating control, the control unit 8 changes the drive frequency or the ON duration of the switching element such that an input current to the inverter circuit continuously reaches an input current corresponding to the target heating output. Thus, the heating output from the inverter circuit continuously reaches the target heating output.

Figure 2:
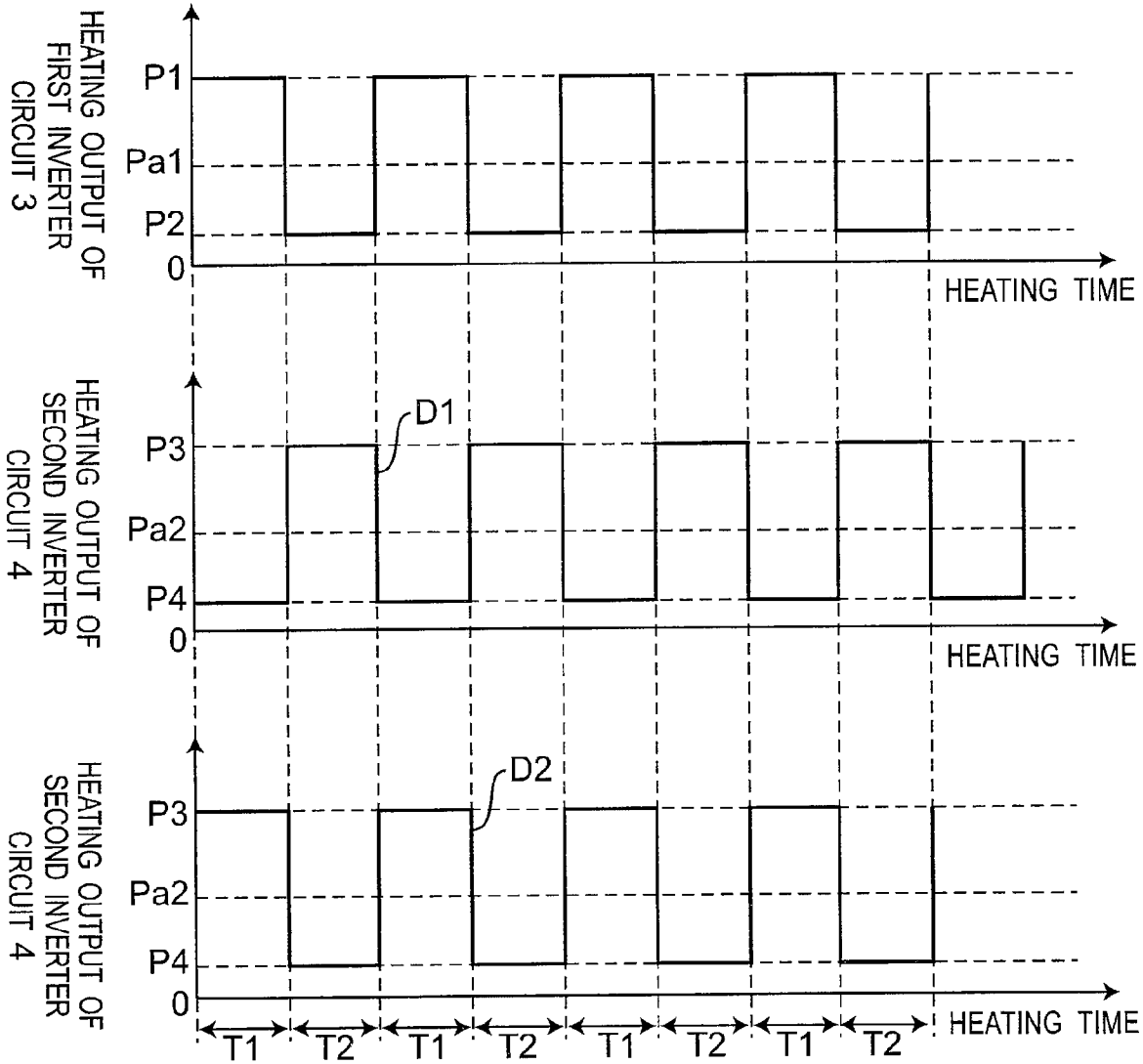
FIG. 2 is a timing chart showing an example of heating outputs from respective first and second inverter circuits 3 and 4 in FIG. 1 obtained when the first and second inverter circuits 3 and 4 operates simultaneously.

In addition, when the control unit 8 makes both the first and second inverter circuits 3 and 4 operational, the control unit 8 controls the first and second inverter circuits 3 and 4 by duty control such that an average heating output from the first inverter circuit 3 reaches the first target heating output, and an average heating output from the second inverter circuit 4 reaches the second target heating output. FIG. 2 is a timing chart showing an example of heating outputs from respective first and second inverter circuits 3 and 4 in FIG. 1 obtained when the first and second inverter circuits 3 and 4 operates simultaneously. As shown in FIG. 2, when loads such as pans are placed on the first and second heating coils 5 and 6, and heating controls are done for the first and second heating coils 5 and 6 simultaneously, the control unit 8 controls the first inverter circuit 3 during a first period T1 such that the heating output reaches a predetermined first heating output P1 larger than the first target heating output, the control unit 8 controls the first inverter circuit 3 during a second period T2 such that the heating output reaches a predetermined second heating output P2 smaller than the first target heating output, and the control unit 8 repeats the first period and the second period (see a heating pattern at the top in FIG. 2).

Further, the control unit 8 controls the second inverter circuit 4 during the first period T1 such that the heating output reaches a predetermined third heating output P3 larger than the second target heating output, the control unit 8 controls the second inverter circuit 4 during the second period T2 such that the heating output reaches a predetermined fourth heating output P4 smaller than the second target heating output, and the control unit 8 repeats the first period and the second period (see a heating pattern D2 at the bottom in FIG. 2). Alternatively, the control unit 8 controls the second inverter circuit 4 during the first period T1 such that the heating output reaches the fourth heating output P4, the control unit 8 controls the second inverter circuit 4 during the second period T2 such that the heating output reaches the third heating output P3, and the control unit 8 repeats the first period and the second period (see a heating pattern D1 at the middle in FIG. 2). Referring to FIG. 2, the method for controlling the first and second inverter circuits 3 and 4 during each of the periods T1 and T2 is the same as that of the continuous heating control.

Referring to FIG. 2, the durations of the first period T1 and the second period T2 are the same with each other (e.g., 10 milliseconds). Therefore, an average heating output Pa1 from the first inverter circuit 3 is an average of the first heating output P1 and the second heating output P2. The control unit 8 controls the first and second heating outputs P1 and P2 such that the average heating output Pa1 reaches the first target heating output of the first inverter circuit 3. In addition, an average heating output Pa2 from the second inverter circuit 4 is an average of the third heating output P3 and the fourth heating output P4. The control unit 8 controls the third and fourth heating outputs P3 and P4 such that the average heating output Pa2 reaches the second target heating output of the second inverter circuit 4.

Referring to FIG. 2, for example, when the first heating output P1 is 10 times the second heating output P2, it is necessary to set the first heating output P1 to a value about twice the first target heating output. As described above, under the duty control, the heating outputs during the first period T1 and the heating outputs during the second period T2 (P1 and P2; and P3 and P4) are different from each other, and it is necessary to provide a period for heating operation with a larger heating output than the target heating output. Therefore, in order to achieve the same average heating output as the target heating output obtained during the continuous heating control when performing the duty control, it is necessary to provide a period for heating operation with a larger heating output than that of the continuous heating control.

Further, referring to FIG. 1, the control unit 8 operates each of the first and second inverter circuits 3 and 4, in a manual heating mode for heating control to heat with a predetermined heating output according to a user's settings, or in an automatic heating mode for automatic heating control according to a predetermined heating output sequence. The automatic heating mode is, for example, a fry cooking mode. In the fry cooking mode, the control unit 8 first starts heating operation with a heating output of 1500 W to heat a pan containing oil, and estimates the amount of the oil in the pan at the beginning of a heating period with a heating output of 1500 W (hereinafter, referred to as "1500 W heating period"), based on the temperature gradient at the bottom of the pan. Based on the estimation of the amount of the oil and the temperature at the bottom of the pan, the control unit 8 determines the duration of the 1500 W heating period. Then, after the expiration of the 1500 W heating period, heating operation with a heating output of 1000 W and heating operation with a heating output of 0 W are repeated to increase or keep the temperature of the oil to/at a predetermined temperature. The temperature at the bottom of the pan is detected by a temperature sensor (not shown), and is outputted to the control unit 8.

Next, it is assumed that when the control unit 8 makes only one of the first and second inverter circuits 3 and 4 operational by the above-described continuous heating control, the other inverter circuit is further made operational according to, for example, a user's command. With respect to such a case, the operation of the control unit 8 will be described below.

When the control unit 8 makes only one of the first and second inverter circuits 3 and 4 operational, the control unit 8 inhibits the other inverter circuit from being operational in the automatic heating mode. In this case, the other inverter circuit cannot newly start heating operation in the automatic heating mode, and is operable only in the manual heating mode. When the control unit 8 makes both the first and second inverter circuits 3 and 4 operational in the manual heating mode, the control unit 8 controls the inverter circuits 3 and 4 by the duty control (see FIG. 2).

In addition, when the control unit 8 makes only one of the first and second inverter circuits 3 and 4 operational in the automatic heating mode, the control unit 8 controls the one operating inverter circuit by the continuous heating control, and inhibits the other inverter circuit from being operational. Therefore, the other inverter circuit cannot newly start heating operation.

Next, specific advantageous effects of the induction heating cooker according to the present embodiment will be described.

As described above, in order to achieve the same average heating output as the target heating output obtained during the continuous heating control when performing the duty control, it is necessary to provide a period for heating operation with a larger heating output than that of the continuous heating control. Therefore, the maximum heating output under the duty control is larger than the maximum heating output during the continuous heating control, and there is a high possibility that the limiter unit 7 determines that the heating output is equal to or larger than the heating output threshold. Hence, in the induction heating cooker according to the present embodiment, for example, when the first inverter circuit 3 is made operational in the above-described fry cooking mode, the second inverter circuit 4 is made operational in the manual heating mode with a heating output of 1000 W according to a user's settings, and each of the first and second inverter circuits 3 and 4 is controlled by the duty control (see, for example, FIG. 2), the following problems occur.

When the limiter unit 7 detects that the heating output from the first inverter circuit 3 is equal to or larger than the heating output threshold during a 1500 W heating period in the fry cooking mode of the first inverter circuit 3, the control unit 8 limits the heating output from the first inverter circuit 3 to, for example, 1000 W or less. As a result, since the heating output decreases from 1500 W to 1000 W, an increase in the temperature at the bottom of the pan during the 1500 W heating period becomes slow, resulting in that the relationship between the gradient of the temperature at the bottom of the pan and the amount of oil deviates from a relationship designed in advance. Accordingly, it is not possible to appropriately determine the duration of the 1500 W heating period, making it difficult to achieve sufficient cooking performance for fry cooking.

On the other hand, according to the present embodiment, when only the first inverter circuit 3 is first operating in the fry cooking mode, the first inverter circuit 3 is controlled by the continuous heating control, and the second inverter circuit 4 is inhibited from being further made operational. Therefore, during a period in which the first inverter circuit 3 is operating for heating in the fry cooking mode, the second inverter circuit 4 is not made operational. Hence, it is possible to limit the heating output from the first inverter circuit 3 to less than the heating output threshold, thus avoiding the heating output from the first inverter circuit 3 reaching equal to or larger than the heating output threshold, and avoiding limitation of the heating output to smaller than 1500 W. Therefore, according to the present embodiment, since the control unit 8 makes only one of the first and second inverter circuits 3 and 4 operational for heating control in the automatic heating mode, a heating output is not limited by the limiter unit 7, thus achieving heating control in the automatic heating mode. That is, it is possible to avoid unstable heating control without sufficient cooking performance, arose from lack of heating control in the fry cooking mode with a predetermined heating output. Accordingly, it is possible to improve safety as compared to the prior art.

In addition, when the control unit 8 makes only one of the first and second inverter circuits 3 and 4 operable, the control unit 8 inhibits the other inverter circuit from being further made operational in the automatic heating mode. Therefore, it is possible to avoid unstable heating control without sufficient cooking performance, arose from lack of heating control in the automatic heating mode with a predetermined heating output, due to limitation of a heating output imposed by a limiter unit 7 during heating operation under the duty control requiring a larger maximum heating output than that of the continuous heating control. Accordingly, it is possible to improve safety as compared to the prior art. Further, it is possible to improve usability, as compared to the case in which a heating output is limited by the limiter unit 7 due to an external factor such as a pan's movement during heating control under the duty control in the automatic heating mode, and then, the heating control is changed from the duty control to the continuous heating control.

In addition, for example, when one of the inverter circuits is operating in the manual heating mode with a maximum heating output available as a user's settings, it is not possible to make the other heating coil operational in the automatic heating mode. Hence, when a pan with a minimum guaranteed heatable diameter is placed on the center of the first or second heating coil 5 or 6 during heating control under the duty control in the automatic heating mode, it is possible to achieve sufficient cooking performance by performing heating operation under the continuous heating control in the automatic heating mode, even if a heating output is limited by a limiter unit 7.

In addition, when the control unit 8 makes only one of the first and second inverter circuits 3 and 4 operational in the automatic heating mode, the control unit 8 inhibits the other inverter circuit from being operational. Therefore, it is possible to avoid unstable heating control without sufficient cooking performance, arose from lack of heating control in the automatic heating mode with a predetermined heating output, due to limitation of a heating output imposed by a limiter unit 7 during heating operation under the duty control requiring a larger maximum heating output than that of the continuous heating control. Accordingly, it is possible to improve safety as compared to the prior art. Further, it is possible to improve usability, as compared to the case in which a heating output is limited by the limiter unit 7 due to an external factor such as a pan's movement during heating control under the duty control in the automatic heating mode, and then, the heating control is changed from the duty control to the continuous heating control.

In addition, for example, when one of the inverter circuits is operating in the automatic heating mode, it is not possible to make the other inverter circuit cannot operational in the manual heating mode with a maximum heating output available as a user's settings. Hence, for example, when a pan with a minimum guaranteed heatable diameter is placed on the center of the first or second heating coil 5 or 6 during heating control under the duty control in the automatic heating mode, it is possible to achieve sufficient cooking performance by performing heating operation under the continuous heating control in the automatic heating mode, even if a heating output is limited by a limiter unit 7.

As described above, according to the present embodiment, when the control unit 8 makes one of the first and second inverter circuits 3 and 4 operational in the automatic heating mode, the control unit 8 controls only the one operating inverter circuit by the continuous heating control. Thus, it is possible to achieve a predetermined target heating output with a lower maximum heating output than that for the case of controlling by the duty control. Hence, it is possible to avoid unstable heating control without sufficient cooking performance, arose from lack of heating control in the automatic heating mode, due to limitation of a heating output imposed by a limiter unit 7. Accordingly, it is possible to improve safety as compared to the prior art.

According to the present embodiment, the heating outputs P2 and P4 in FIG. 2 may be set to substantially zero to stop a heating output, and the second inverter circuit 4 may be controlled to repeat the heating pattern D1 of the timing chart at the middle in FIG. 2. Thus, since the first and second inverter circuits 3 and 4 do not perform heating operation with the same timing, it is possible to eliminate interference sound (roaring sound).

In addition, although the automatic heating mode of the present embodiment is the fry cooking mode, the present invention is not limited thereto, and any heating mode (cooking mode) may be adopted as long as the heating mode (cooking mode) includes automatic heating control according to a predetermined heating output sequence.

Further, although each of the durations of the first and second periods T1 and T2 according to the present embodiment is set to 10 milliseconds as shown in FIG. 2, the present invention is not limited thereto. The durations of the first and second periods T1 and T2 may be different from each other, or may be durations other than 10 milliseconds. Further, although the control unit 8 of the present embodiment controls the first and second heating outputs P1 and P2 such that the average heating output Pa1 reaches the target heating output of the first inverter circuit 3, and controls the third and fourth heating outputs P3 and P4 such that the average heating output Pa2 reaches the target heating output of the second inverter circuit 4, the present invention is not limited thereto. The control unit 8 may control the duty ratio of the first inverter circuit 3 such that the average heating output Pa1 reaches the target heating output of the first inverter circuit 3, and may control the duty ratio of the second inverter circuit 4 such that the average heating output Pa2 reaches the target heating output of the second inverter circuit 4.

Furthermore, although an induction heating cooker is described as an example of the present invention in the above-described embodiment, the present invention is not limited thereto. The present invention may be applied to an induction heating apparatus provided with two inverter circuits.

INDUSTRIAL APPLICABILITY

According to the induction heating apparatus of the present invention as described above, when one of the first and second inverter circuits is made operational in the automatic heating mode for the automatic heating control according to the predetermined heating output sequence, the first and second inverter circuits are inhibited from being controlled by the duty control.

Thus, when one of the first and second inverter circuits is made operational in the automatic heating mode, only the one inverter circuit made operational is controlled by the continuous heating control. Therefore, it is possible to achieve the predetermined target heating output at a lower maximum heating output than as compared to the case of controlling by the duty control. Hence, it is possible to avoid unstable heating control without sufficient cooking performance arose from lack of heating control in the automatic heating mode due to limitation of a heating output imposed by a limiter unit. Accordingly, it is possible to improve safety as compared to the prior art.

The induction heating apparatus according to the present invention is effectively available as an induction heating apparatus for general home use or for professional use.

The invention claimed is:

1. An induction heating apparatus comprising:

a first inverter circuit configured to supply a high-frequency current to a first heating coil;

a second inverter circuit configured to supply a high-frequency current to a second heating coil; and a control unit configured to control the first and second inverter circuits, wherein, when the control unit makes both the first and second inverter circuits operational, the control unit controls the first and second inverter circuits by duty control such that an average heating output from the first inverter circuit reaches a predetermined first target heating output, and an average heating output from the second inverter circuit reaches a predetermined second target heating output, wherein, when the control unit makes only the first inverter circuit operational, the control unit controls the first inverter circuit by continuous heating control such that a heating output from the first inverter circuit reaches the first target heating output, wherein, when the control unit makes only the second inverter circuit operational, the control unit controls the second inverter circuit by the continuous heating control such that a heating output from the second inverter circuit reaches the second target heating output, and wherein, when the control unit makes one of the first and second inverter circuits operational in an automatic heating mode for automatic heating control according to a predetermined heating output sequence, the control unit inhibits the first and second inverter circuits from being controlled by the duty control.

2. The induction heating apparatus as claimed in claim 1, wherein, when the control unit makes only one of the first and second inverter circuits operational, the control unit inhibits the other inverter circuit from being operational in the automatic heating mode.

3. The induction heating apparatus as claimed in claim 1, wherein, when the control unit makes only one of the first and second inverter circuits operational in the automatic heating mode, the control unit inhibits the other inverter circuit from being operational.

4. The induction heating apparatus as claimed in claim 1, further comprising:

a limiter unit configured to determine whether or not each of the heating outputs from the first and second inverter circuits is equal to or larger than a predetermined heating output threshold, wherein, when the heating output from the first inverter circuit is determined to be equal to or larger than the heating output threshold, the control unit controls the first inverter circuit such that the heating output from the first inverter circuit reaches a predetermined value less than the heating output threshold, and wherein, when the heating output from the second inverter circuit is determined to be equal to or larger than the heating output threshold, the control unit controls the second inverter circuit such that the heating output from the second inverter circuit reaches a predetermined value less than the heating output threshold.

5. The induction heating apparatus as claimed in claim 1, wherein, the control unit controls the first inverter circuit during a first period such that the heating output from the first inverter circuit reaches a predetermined first heating output larger than the first target heating output, the control unit controls the first inverter circuit during a second period subsequent to the first period such that the heating output from the first inverter circuit reaches a predetermined second heating output smaller than the first target heating output, and the control unit repeats the first period and the second period, and wherein, the control unit controls the second inverter circuit during the first period such that the heating output from the second inverter circuit reaches one of a predetermined third heating output larger than the second target heating output and a predetermined fourth heating output smaller than the second target heating output, the control unit controls the second inverter circuit during the second period such that the heating output from the second inverter circuit reaches the other one of the third and fourth heating outputs, and the control unit repeats the first period and the second period.

6. The induction heating apparatus as claimed in claim 5, wherein, the control unit controls the second inverter circuit during the first period such that the heating output from the second inverter circuit reaches the fourth heating output, and the control unit controls the second inverter circuit during the second period such that the heating output from the second inverter circuit reaches the third heating output, and wherein, the control unit sets each of the second and fourth heating outputs to substantially zero.

7. The induction heating apparatus as claimed in claim 1, further comprising:

a rectifier circuit configured to rectify and smooth an alternating-current power from an alternating-current power supply and outputting a direct current, wherein, the first and second inverter circuits are connected to the rectifier circuit in parallel, and each of the first and second inverter circuits converts the direct current from the rectifier circuit, to the high-frequency current.

* * * * *